United States Patent [19]

Ploppa et al.

[11] Patent Number: 4,773,236

[45] Date of Patent: Sep. 27, 1988

[54] DEVICE FOR CONTROL OF A FLAT-BED KNITTING MACHINE

[75] Inventors: Jürgen Ploppa, Pfullingen; Franz Schmid, Bodelshausen; Gerd Mak; Horst Fries, both of Reutlingen, all of Fed. Rep. of Germany

[73] Assignee: H. Stoll GmbH & Co., Fed. Rep. of Germany

[21] Appl. No.: 94,607

[22] Filed: Sep. 9, 1987

[30] Foreign Application Priority Data

Sep. 10, 1986 [DE] Fed. Rep. of Germany ..... 3630855
Mar. 6, 1987 [DE] Fed. Rep. of Germany ..... 3707174

[51] Int. Cl.[4] ..... D04B 7/00
[52] U.S. Cl. ..... 66/75.1
[58] Field of Search ..... 66/64 R, 60 R, 75.2

[56] References Cited

U.S. PATENT DOCUMENTS

| | | | |
|---|---|---|---|
| 3,783,642 | 1/1974 | Hadam et al. | 66/75.2 |
| 4,006,611 | 2/1977 | Kahan | 66/75.2 |
| 4,081,974 | 4/1978 | Jaffe et al. | 66/75.2 |
| 4,222,247 | 9/1980 | Hashimoto et al. | 66/75.2 |
| 4,697,438 | 10/1987 | Muller et al. | 66/75.2 |

FOREIGN PATENT DOCUMENTS

| | | | |
|---|---|---|---|
| 2203528 | 9/1972 | Fed. Rep. of Germany | 66/75.2 |

*Primary Examiner*—Ronald Feldbaum
*Attorney, Agent, or Firm*—Jones, Tullar & Cooper

[57] ABSTRACT

A device for the control of a flat-bed knitting machine for needle selection and/or the determination of the position of the carriages on the needle beds is provided with a pulse generator device having magnetically controllable resistors in the form of double differential magnetoresistors and being fixed on a first machine element, and with a magnetically conductive pulse generator board device being fixed on a second machine element. The two machine elements are movable in relation to each other and the magnetoresistors generate separate and phase-shifted in respect to each other pulse sequences during the relative movement to the pulse generator board device. So that in a device a control, especially of the needle selection, can take place at considerably higher speed a determination of direction, and if needed, an adjustment to the speed of the carriage being possible at the same time, it has been provided that the pulse generator board device has a first pulse generator board arranged along a needle bed, the tooth/grove gauge of which is finer that the finest needle gauge in the needle bed, that a pulse generator, fixed on the carriage, is associated with the first pulse generator board, the magnetoresistors of which are distant by approximately $\lambda_1/4$ ($\lambda_1$ being the size of the impulse period), and that at predetermined intervals several successive first rectangular control pulses (I–VIII) are derived from the first pulse sequences phase-shifted by $\lambda_1/4$ ($A_{FP}$, $B_{FP}$) by detecting the crossover and comparing the normalized pulse sequences.

14 Claims, 3 Drawing Sheets

DEVICE FOR CONTROL OF A FLAT-BED KNITTING MACHINE

CROSS-REFERENCE TO RELATED APPLICATION

This application relates in part to application, Ser. No. 095004, filed 9-9-87.

FIELD OF THE INVENTION

The present invention relates to a device for the control of a flat-bed knitting machine, especially for needle selection and/or determination of the position of the carriages on the needle beds, with a pulse generator device having magnetically controllable resistors in the form of magnetoresistors, preferably double differential magnetoresistors, fastened to a first machine element, and with a magnetically conducting pulse generator board device fastened to a second machine element, the two machine elements being movable in relation to each other, and the magnetoresistors generating separate pulse sequences phaseshifted in respect to each other during the relative motion in respect to the pulse generator board device.

BACKGROUND OF THE INVENTION

In such a device, known from German Published patent application DE-AS No. 21 40 063, for the control of a flat-bed knitting machine, the pulse generator board device either has a toothed comb board or a hole board with two rows of holes disposed on top of each other, which enter an air gap of the pulse generator equipped with one or, respectively, two simple magnetoresistors arranged on top of each other. The gauge of the teeth or the gauge of the recesses or holes corresponds to the needle gauge in the needle bed. Because of the offset arrangement of the two rows of holes, pulse sequences which are phase-shifted with respect to each other can be generated. In each case a control pulse or control signal is generated during each change of the magnetic flow, i.e. in accordance with the tooth or, respectively, hole gauge and thereby the needle gauge.

In the needle selection so far made, for example with the aid of magnetically-actuable jacks, the control time can be relatively long, because these jacks are disposed in several rows offset against each other and therefore can be selected far in advance of the subsequent mechanical actuation of the respective needles. For this reason a changing or changed carriage speed is of no consequence. Additionally, in connection with the known flat-bed knitting machines work is performed across the entire width of the needle bed and a stop face change is performed mechanically during the lift reversal of the carriage, pre-setting or determining the direction of travel of the several elements. Therefore a known device for the control of a flat-bed knitting machine is not required to perform a determination of the lift direction. Furthermore, since as mentioned above, the tooth or, respectively, hole boards are adapted with respect to their gauge to the needle gauge, it is necessary to manufacture tooth or, respectively, hole boards corresponding to each needle gauge which is costly in the manufacturing sense. Later developments in flat-bed knitting machines, however, are directed to the ability to perform the lift reversal of the carriage at any place along the length of the needle beds. Furthermore, in newer selection systems which, for example, provide, maintain and, at the time of selection, either magnetically continue to maintain or discard all needles, control must take place within shorter time intervals, not in the least because of higher carriage speeds.

SUMMARY OF THE INVENTION

It is therefore an object of the present invention to provide a device for the control of flat-bed knitting machines of the type mentioned above in which control, especially for the purpose of needle selection, can take place at considerably greater speed, at the same time making possible a recognition of the direction and, if required, adaptation to the carriage speed.

This object is achieved in a device for the control of a flat-bed knitting machine of the type mentioned by the fact that the pulse generator board device has a first pulse generator board disposed along at least one needle bed, the tooth/groove gauge of which is equal to or finer than the finest needle gauge in the needle bed, in that a first pulse generator fastened on the carriage is associated with the first pulse generator board, the magnetoresistors of which are spaced apart from each other by approximately $\lambda_1/4$ ($\lambda_1$ being the magnitude of the pulse period), and in that at pre-determined intervals several successive first rectangular control pulses (I–VIII) are derived from the first pulse sequences phase-shifted by $\lambda_1/4$ ($A_{FP}$, $B_{FP}$) by detecting the cross-over and/or comparing the normalized pulse sequences ($\overline{A}$, $\overline{B}$).

A considerably higher resolution of the control or, respectively, of the pulse generator device is possible by the steps in accordance with the invention without entailing considerable additional effort. By generating a plurality of individual rectangular control pulses within the period created by the pulse generator during the change of the magnetic flow, an exact control of the needles is possible within a very short time. Depending on the carriage speed, that pulse out of the plurality of rectangular control pulses which, during the forward movement, is responsible or, has been selected for the control of the corresponding needle can be determined. Additionally, the time sequence of these rectangular control pulses can be used to signal or, determine the lift direction of the carriage only. By means of this step it is further possible to use, independently of the needle gauge of the respective flat-bed knitting machine, the same pulse generator board with a set tooth gauge, since the tooth gauge of the pulse generator board and the different needle gauges always have a common multiple, so that for the adaptation or, assignment of the two gauges to each other only a calculator is required. Therefore a pulse generator adapted to the respective selected tooth gauge of the pulse generator boards and to the spatially offset disposition of the magnetoresistors for the phase-shifted generation of two pulse sequences can be used from the start in a particularly simple manner. This pulse generator/pulse generator board unit then can be used for every needle gauge of a knitting machine.

In accordance with a preferred embodiment of the present invention according to which a second pulse generator board is provided along the needle bed the tooth/groove gauge of which differs by a small amount in the direction toward coarse from that of the first generator board, there exists the possibility of a vernier measurement with the aid of the second pulse generator/pulse generator board unit connected with and attuned to the first unit, by means of which a generally exact determination of the carriage(s) within the length of the needle bed can be performed.

In the first as well as in the second pulse generator/-pulse generator board unit eight rectangular control pulses are generated per period of the pulse sequences by the derivation of four different intermediate rectangular pulse sequences from the points in time of the cross-overs of the first and second pulse sequences and the points in time at which the pulses of the first and second pulse sequences are equal in size or opposedly equal in size and in that those rectangular control pulses are derived from the intermediate rectangular control pulses the width of which corresponds to the phase shifting of the intermediate rectangular control pulse sequences. With this eight rectangular control pulses within each period of the sinusoidal pulses generated by the pulse generator ia available in an especially simple and quick manner.

It is economically praticable to utilize the same pulse generator for the aecond pulse generator board as for the first, because the resulting in exactness in the phase-shift of the pulse sequences from the second unit is acceptable.

In accordance with an especially preferred exemplary embodiment of the present invention by which a third pulse generator board is provided along at least one needle bed equipped with a plurality of grooves, for example five to ten, the determination of the position of the carriage on the needle bed has been substantially simplified in respect to the calculating effort required there, because a reference point system is created with the help of the third pulse generator/pulse generator board unit, the reference points of which are dispersed over the length of the needle bed dependent on defined allocations of the rectangular control pulses of the two units. In other words, the reference points distributed on the third pulse generator board along the needle bed determine a very precise location on the needle bed in accordance with the longitudinal measurement or the needle number, so that, depending on the application, a desired other location can be measured or reached from there. Because of these reference points it is not necessary to determine any wanted location by counting from the, for example, starting point at one end of the needle bed. This reference point system makes it possible in the first place to take the carriage at the beginning of the knitting on a flat-bed knitting machine, first to a precise reference point and then, based on the exact knowledge of the location of the reference point, to take it to the knitting start which is in a predetermined way at an exact needle on the needle bed. Secondly, it is possible with the help of this reference point system to detect the reference points during the operation of the knitting machine and, based on their exact allocation to a discrete needle number, to perform a checking function, i.e., whether synchronization, i.e., exact needle operation, is still functioning.

Since the allocations of the first and second pulse generator boards repeat themselves across the needle bed in accordance with their common multiple, it is practicable to evenly distribute the individual reference point across these repetition sectors. The number of the reference points is determined by how many concrete allocations of the first and second unit are numerically possible or, respectively, can be exactly measured in the vernier system. The grooves of the third pulse generator board are distributed approximately evenly over several of the repetition sectors and over the length of the needle bed if the certain values associated with each other of the first and second pulse generator board repeat in several sectors, for example.

A simple way for the use of one and the same pulse generator device for needle beds with differing needle gauges is provided by associating the evaluation and calculating unit of the flat-bed knitting machine with the pulse generator board devices. This is possible since it is required to provided a mechanically stable association for the needle beds of the different needle gauges only once and to feed this association and the needle gauge used which can, if required, be contained in the noted association to the evaluation and calculating unit. In a practical manner the mechanically beat association is selected according to which the edge of one of the grooves of the third pulse generator board is flush with a defined needle channel in the needle bed.

It is possible in a simple way to adapt the needle-exact control to differing carriage speeds (also in the case of extra slow speed) by selecting a rectangular control pulse from the first rectangular control pulses and in that this selected rectangular control pulse leads, depending on the carriage speed, in relation to the rectangular control pulse directly associated with the respective needle to be selected. taking into consideration the length of time required for the creation of the selective magnetio control field. Only that pulse amount the rectangular control pulses appearing during a tooth/-groove board or, respectively, needle bed gauge being precessed in an advantageous manner is selected. For example. the one rectangular control pulse which locally overlaps the needle to be selected can be considered as immediately associated with the needle to be selected. In the device mentioned above such adaptation would only be possible by means of extensive time (delay) members and even then only in a limited way (extra slow speed excepted), since only a single first pulse is created per needle gauge.

Further details of the invention can be seen from the subsequent description in which the invention is described in detail and explained by means of the exemplary embodiment shown in the drawings.

DETAILED DESCRIPTION OF THE PREFERRED EMBODIMENT

Figure 1:
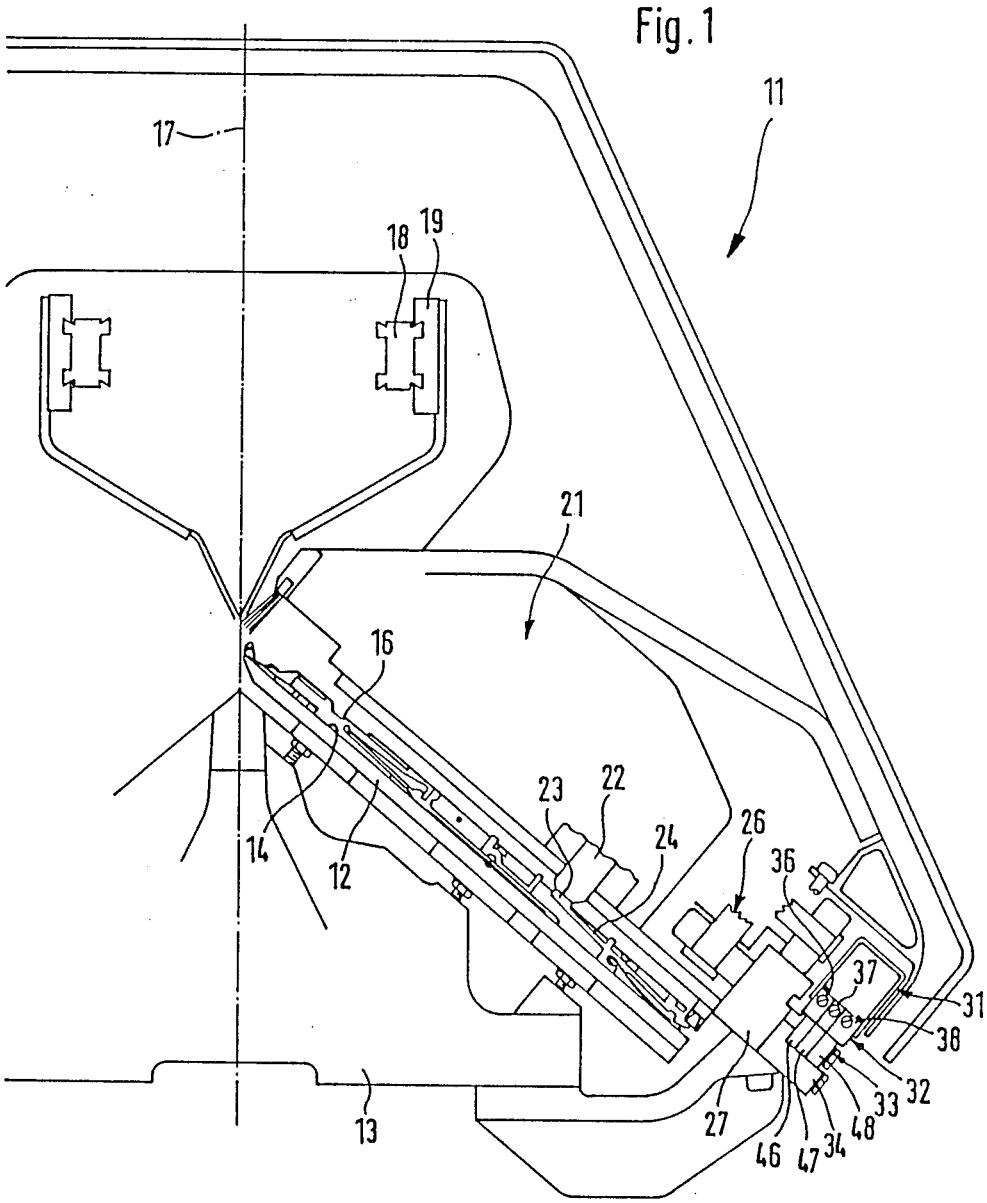
FIG. 1 is a schematic cross section of flat-bed knitting machine provided with a control device in accordance with the present invention.

FIG. 1 shows a flat-bed knitting machine 11 with a V-shaped needle bed, in which only the area of the front needle bed 12, which is fixed and disposed on a machine element 13, is shown. The needle bed 12 is provided with longitudinally extending channels 14 in which the needles 16 are movable back and forth in the customary way with respect to the vertical longitudinal central plane 17 of the flat-bed knitting machine 11. The needle gauge can be optionally chosen. Yarn is supplied to the needles 16 via yarn guides 19 which are fastened to rails 18 extending parallel to the needle bed 12 and which are movable back and forth.

Along the needle bed 12 a carriage 21 is guided movably back and forth which, in addition to corresponding cam parts, supports a needle selection system 22 which, in the exemplary embodiment shown, can press the base 23 of a needle jack 24 into the needle channel 14 in the needle bed 12 for the subsequent actuation or non-actuation of the respective needle 16 by cam elements. The carriage 21 is guided by means of a guide roller arrangement 26 on a guide rail 27 fastened on the machine element 13 along the needle bed 12.

The flat-bed knitting machine 11 is provided with a control device 31, the pulse generator device 32 of which is fixed to the carriage and the pulse generator board or control board device 33 of which is fixed in place on the machine element 13 by a board support 34. The pulse generator board device 33 extends across the entire length of the neddle bed 12 and is swept during the movement of the carriage 21 at a short distance by the pulse generator device 32.

Figure 2:
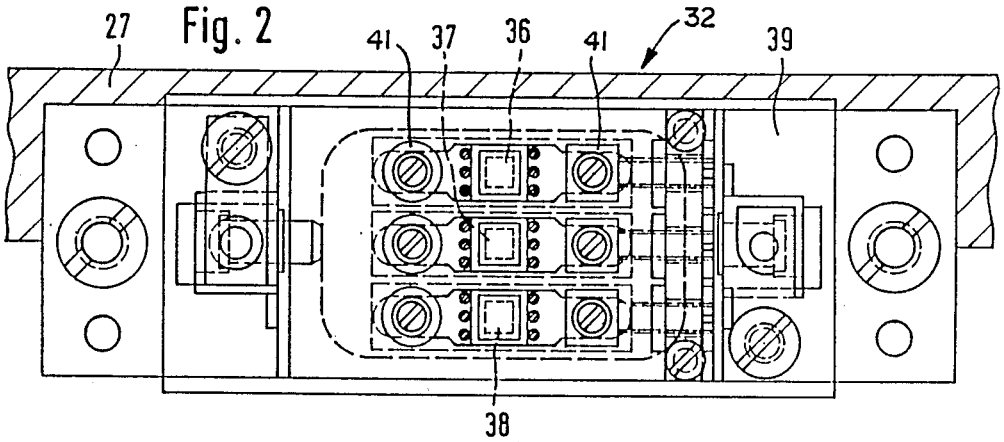
FIG. 2 is a bottom view of the pulse generator device of the control device in accordance with FIG. 1.
Figure 3:
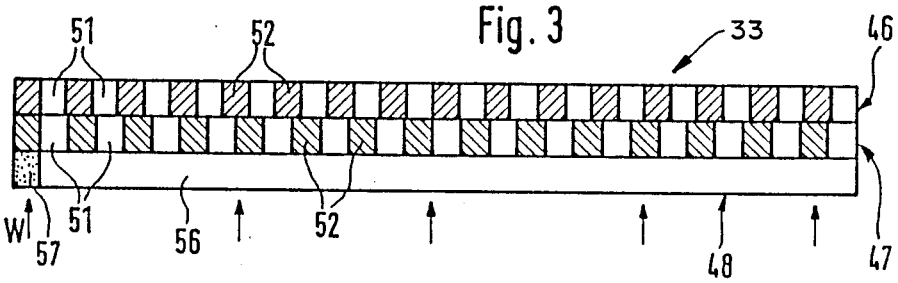
FIG. 3 is a top view of the pulse generator board device of the control device in accordance with FIG. 1.

FIGS. 2 and 3 show in a schematic bottom and top view the pulse generator device 32 and the pulse generator board device 33. The pulse generator device 32 has three pulse generators 36, 37 and 38 mounted on gimbals on a support 39 and adjustably fixed. Each of the pulse generators 36, 37 and 38, identical in the exemplary embodiment shown, has magnetically controllable resistors in the form of double differential magnetoresistors 41, which can be bought commercially in this model with a permanent magnet, as magnetoresistor differential sensors. The pulse generator board devive 33 has three equally long pulse generator or control boards 46, 47, 48 arranged parallel and next to each other and designed as a soft iron element or made permanently magnetic and which are provided in different ways with teeth or grooves. The first pulse generator board 46 is swept or sensed by the first pulse generator 36, the second pulse generator board 47 by the second pulse generator 37 and the third pulse generator board 48 by the third pulse generator 38. In the course of the sweep of the pulse generator board 46, 47 or 48 by the associated pulse generator 36, 37, or 38 the change in magnetic field strength, depending on whether a tooth or a groove of the pulse generator board is located opposite the pulse generator, is measured because the magnetic resistance in the magnetoresistors 41 change depending on the changing magnetic field strength, as described below in connection with FIG. 4. At this point it should be noted that, as in the front needle bed 12, a corresponding pulse generator and pulse generator board device can also be provided at the not shown rear needle bed of the flat-bed knitting machine 11, but that it is customarily sufficient to equip these devices on the rear needle bed only with a control device in the form of a first pulse generator and a first pulse generator board.

Figure 5:
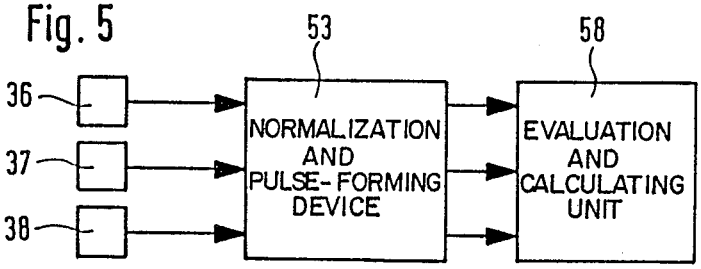
FIG. 5 is a block diagram of a control device in accordance with which the pulses shown in FIG. 4 are generated or processed.
Figure 4:
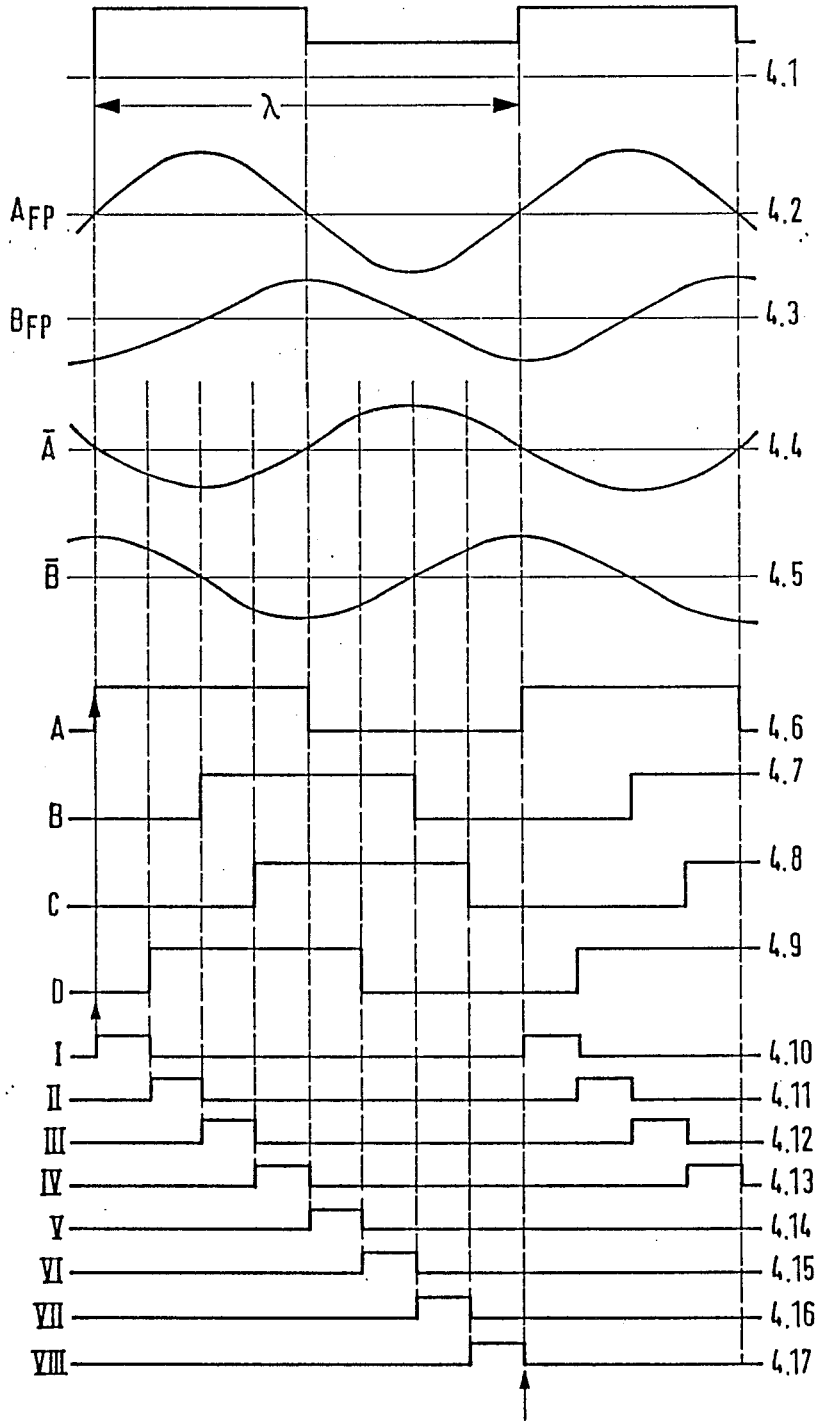
FIG. 4 is a graph of the pulses generated by the control device.

The basic operation of the control units 36/46 and 37/47 of the control device 31 is now described by means of FIGS. 4 and 5. In partial FIG. 4.1 a gauge or period of the pulse generator board 46 or 47, i.e. a tooth or ridge 51 and an adjacent groove 52, are shown. When the pulse generator 36 or 37 sweeps the pulse generator board 46 or 47, the sinusoidal pulse per period or gauge shown in partial FIG. 4.2, i.e. a total pulse sequence of $A_{FP}$, is generated by one pair of the differential magnetoresistors of the pulse generator. The quality of the sinusoidal shape of this pulse sequence $A_{FP}$ depends on the groove/ridge ratio of the pulse generator board. The second pair of the differential magnetoresistors of the pulse generator 36 or 37 is disposed spatially displaced with respect to the first pair of the magnetoresistors of the same pulse generator 36 or 37 by a quarter of the period $\lambda$ of the pulse sequence or by a quarter of the groove/ridge gauge of the pulse generator board 46 or 47, so that the result is the sinusoidal pulse sequence $B_{FP}$, phase-shifted by $\lambda/4$ or $\frac{3}{4}\lambda$, $5/4\ \lambda$ in accordance with partial FIG. 4.3. In accordance with FIG. 5, these signals are fed to a normalization and pulse-forming device 53. In this device 53 the pulse sequences $A_{FP}$ and $B_{FP}$, are normalized into pulse sequences $\overline{A}$ and $\overline{B}$, because they might have differing amplitudes, as is shown in partial FIGS. 4.4 and 4.5. These normalized sinusoidal impulse sequences $\overline{A}$ and $\overline{B}$ are then transformed in the device 53 into a total of four rectangular pulses A, B, C and D in accordance with the partial FIGS. 4.6 to 4.9. The criteria for transformation are firstly the cross-overs of the pulse sequence $\overline{A}$ (rectangular pulse sequence A) and pulse sequence $\overline{B}$ (rectangular pulse sequence B), then the times when the normalized pulse sequences $\overline{A}$ and $\overline{B}$ are of equal size (rectangular pulse sequence C) and when the two normalized pulse sequences $\overline{A}$ and $\overline{B}$ are opposed and of the same size (reactangular pulse sequence D).

These four rectangular pulse sequences A–D, phase-shifted with respect to each other, are now transformed per period $\lambda$ into eight shorter rectangular control pulse sequences I to VIII, one single pulse of which occurs per period and of which all pulses occur per period immediately in sequence, i.e. without overlapping, filling the period $\lambda$. In other words, within each gauge of the pulse generator board 46 or 47, consisting of ridge 51 and groove 52, eight pulses I to VIII are generated, as shown in partial FIGS. 4.10 to 4.17.

The specific difference between the two control units 36/46 and 37/47 lies in the gauge of the pulse generator boards 46 and 47. The pulse generator board 46 has a so-called 16-gauge, i.e. per unit of length, for instance an inch, the board is provided with sixteen groove/ridge gauges. This 16-gauge is at least equal to, however in most cases finer than the needle gauge in the needle bed 12. This pulse generator board 46 and the pulse generator 36 associated with it are used in connection with flat-bed knitting machines 11 having standard needle gauge. The groove/ridge gauge of the second pulse generator board 47 is equipped with a more coarse gauge, namely in the present case with a 15-gauge as shown in FIG. 3. This means that the groove/ridge sequence of the pulse generator board 47 is displaced within the given unit of length, for example an inch, against that of the pulse generator board 46 and overlaps differently. This is therefore also true for the pulses generated during the sweep by the respective pulse generators 36 and 37 and the eight pulses I to VIII derived therefrom which take up in a defined way respectively a certain different position to each other. This results in a vernier-like disposition of the two pulse generator boards 46 and 47 or the eight pulses I to VIII derived therefrom.

While it is possible to detect the direction of lift of the first pulse generator 36 and thereby of the carriage 21 from the time sequence of those eight pulses I to VIII derived from the control unit 36/46, it is also possible, by means of the vernier-like relation of the respective eight pulses I to VIII generated by the control unit 36/46 to those generated by the control unit 37/47, to make an exact determination of the position within the common multiple of the carriage 21 equipped with the pulse generators 36, 27 atop of the needle bed 12 equipped with the pulse generator boards 46, 47. This exact determination can be easily made within each groove/ridge gauge of the pulse generator boards 46, 47 and thus within each needle gauge in the needle bed 12, since the pulse generator boards 46, 47 have an exactly defined spatial position in relation to the needle bed 12. However, in this type of positional determination of the carriage 21 the individual gauge sectors, i.e. the plurality of the repetition sectors with a length of, for example, one inch (or two inches), must be counted.

To simplify the latter, the above mentioned third control unit 38/48 has been provided, consisting of the pulse generator 38, which can be identical to the pulse generators 36 and 37, and of the pulse generator board 48. This unit 38/48 is used for the generation of reference marks to show within which of the sectors of, for example, the unit of length of one inch the carriage 21 is atop the needle bed 12. For this purpose the pulse generator board 48 is only provided with a groove 57 at individual discrete places, while the ridge 56 is made continuous. The choice of the discrete values is determined by those locations where those pulses I to VIII derived from the first unit 36/46 have a certain differentiable and measurable concrete relation to each other with those rectangular control pulses I–VIII derived from the second unit 37/47. For example, this can be specified by one of the pulses of the second unit 37/47 coinciding with another of the pulses of the first unit 36/46 or by the appearance of a certain pulse of the second unit 37/47 during the change of another pulse of the first unit 36/46. In this manner it is possible to determine, for example, five to ten discrete values W which can be reasonably differentiated and to such positions or points in time is assigned a reference mark, i.e. a change from the ridge 56 to the groove 57 in the third pulse generator board 48. However, these possible discrete values are distributed over the plurality of the repetition sectors, within which, with the aid of the first and second units, a positional determination along the needle bed 12 is possible. This means that reference marks are provided, distributed over the needle bed, which can indicate a certain position, so that counting of the successive repetition sectors can either be considerably reduced to the number respectively provided between two reference marks or, if counting is continued, can serve as a check only.

The reference marks are distributed along the needle bed such that under all possible operational conditions at least one of these reference marks on the pulse generator board is crossed by the associated pulse generator disposed on the carriage device. The third unit 38/48 functions in the customary way, i.e. signals generated by the third pulse generator 38 are used directly or simply by reforming into a rectangular pulse. The calculated association and fixing of the reference marks takes place in the evaluation and calculation unit 58 in accordance with FIG. 5, with which the third control unit 38/48 is also connected, if required via the pulse-forming device 53.

It is possible with the aid of these reference marks W to position the carriage at the beginning of the knitting operation at the exact needle position of the desired start position by moving the carriage to the reference mark next following and from there being able to move it to the associated needle where knitting is to start by means of the positional determination by the vernier-like disposition of the first and second pulse generator boards 46 and 47. In the process of operation the reference marks are used during the respective passing of the carriage 21 to check by means of the vernier association and the association of the reference mark thereto and to a certain needle number whether work proceeds accurately or whether errors, for example in the pulse generator system, are present.

During assembly of a flat-bed knitting machine 11 the needle beds 12 and the device 33 of the three pulse generator boards 46 to 48 is disposed such that at a per se random point along the respective needle bed 12 one of the reference marks of the pulse generator board 48, formed by a groove 57, has a fixed association point. This fixed reference point or, this fixed needle channel may be located at an end, however preferably in a central area, of the respective needle bed. This definite association is performed mechanically such that the device 33 with the pulse generator boards 46 to 48 fixedly arranged with each other is pinned to the corresponding needle bed in such a way that one edge of the groove 57 or, of the reference mark is flush with an edge of the corresponding needle channel 14 in the needle bed 12. A corresponding association between pulse generator device 33 and needle bed 12 takes place in the respective machines during use of the same needle gauge always at the same place, a corresponding association in connection with each needle gauge for gauges of, for example between 2½ and 12, is newly determined in a corresponding manner. In other words, although a particular association to one of the reference marks of the pulse generator board device 33 is selected for needle beds of differing gauges, the respective pulse generator boards 46 to 48 or, their fixed disposition and association with each other remain. Thus one and the same pulse generator device can be used for flat-bed knitting machines with needle beds of different gauge.

The use of a needle bed 12 of a certain gauge and its fixed association with a reference mark of the pulse generator board device 33 is fed to the evaluation and calculation unit 58 and is referenced there with the gauge of the pulse generator board 46. By means of the corresponding evaluation in the evaluation and calculation unit 58 and by means of its correspondingly changed control of the control device 31 it is possible to consider any gauges in the needle beds with correspondingly equal tooth gauge of the individual pulse generator boards 46 to 48 and to control the machine correspondingly.

The high resolution of the pulses emitted by the first unit 36/46 results not only in a needle-correct control of the needle selection unit even at high speeds, but also makes possible an adaptation of the control to different carriage speeds. Since the time needed for the creation of a magnetic field for a selection is known, the control of the respective selection system for a certain needle can be made, so to speak, during the forward motion, depending on the speed with which the carriage moves. In other words if, with a slowly moving carriage the third pulse of the eight rectangular control pulses is designated to control the selection system, with a faster moving carriage for example the second or first pulse of these eight rectangular control pulses will be so designated. This means that, depending on the carriage speed, a moving ahead of the rectangular control pulse responsible for the control takes place. Furthermore the castoff times of the needles or needle jack are changed.

Preferably the vernier-like disposition firstly is of relevance, if the flat-bed knitting machine is switched on or switched on again to check whether the position has been changed, and secondly for the determination of the reference marks.

It is to be understood that the exemplary embodiment described above has been shown only by way of example and that further embodiments and improvements are possible within the scope of the invention.

WHAT IS CLAIMED IS:

1. A device for the control of a flat-bed knitting machine, especially for needle selection and/or determining the position of a reciprocating carriage on the needle bed arrangement of the machine, comprising:

a first and second machine element movable relative to each other;

a pulse generator device mounted to the first machine element, said pulse generator device having at least one pulse generator and magnetically controllable resistors associated therewith, the resistors being spaced apart by approximately ¼ of a pulse period, said resistors generating separate pulse sequences during relative movement of the first and second machine elements, which sequences are phase-shifted with respect to each other by approximately ¼ of a pulse period;

a magnetically conducting pulse generator board device mounted to the second machine element, said pulse generator board device having at least one pulse generator board extending along at least one needle bed arrangement, each pulse generator board possessing a tooth/groove gauge equal to or finer than the smallest needle gauge in the associated needle bed, said pulse sequences being generated as a function of a tooth/groove gauge of a pulse generator board associated with the pulse generator of the resistors generating said pulse sequences; and means for receiving the separate pulse sequences and at pre-determined intervals, generating several successive rectangular control pulses from said pulse sequences.

2. The device as defined in claim 1, wherein the rectangular control pulses are generated by detecting pulse sequence crossover.

3. The device as defined in claim 1, wherein the rectangular control pulses are generated by normalizing said pulse sequences and comparing the normalized pulse sequences.

4. The device as defined in claim 1, wherein the rectangular control pulses are generated by detecting pulse sequence crossover, and by normalizing said pulse sequences and comparing the normalized pulse sequences.

5. The devices as defined in claim 1, wherein eight rectangular control pulses are generated per period of said pulse sequences by the derivation of four different intermediate rectangular pulse sequences from the points in time of the crossovers of said pulse sequences and the points in time at which the pulses of said pulse sequences are equal in size or opposedly equal in size. and wherein the width of said intermediate rectangular pulse sequences correspond to their phase shifting.

6. The device as defined in claim 1, wherein:

the pulse generator device has two pulse generators and associated magnetically controllable resistors, the resistors of the second pulse generator being spaced apart by approximately ¼ of a pulse period, and generating second separate pulse sequences during relative movement of the first and second machine elements, which second pulse sequences are phase-shifted with respect to each other by approximately ¼ of a pulse period;

the magnetically conducting pulse generator board device has a second pulse generator board extending along said needle bed, the tooth/groove gauge of which differs in the direction toward coarse from that of the first pulse generator board; and several successive second rectangular control pulses are generated from the second pulse sequences and a comparison of the relative positions of the first and second rectangular pulses is made in the manner of a vernier measurement.

7. The device as defined in claim 6, further wherein eight second rectangular control pulses are generated per period of the second pulse sequences by the derivation of four different second intermediate rectangular pulse sequences from the point in time of the crossovers of the second pulse sequences and the points in time at which the pulses of the second pulse sequence are equal in size of opposedly equal in size, the width of said second intermediate rectangular pulse sequences corresponds to their phase shifting.

8. The device as defined in claim 6, further wherein the first and second pulse generators are equal.

9. The device as defined in claim 6, further wherein:

the pulse generator device has three pulse generators and associated magnetically controllable resistors;

the magnetically conducting pulse generator board device has a third pulse generating board extending along said needle bed, said third pulse generator board having a plurality of grooves; and the plurality of grooves of said third pulse generator board being associated with certain values associated with the first and second pulse generator boards, said first, second and third pulse generator boards extending next to each other.

10. The device as defined in claim 9, further wherein:

the plurality of grooves comprises five to ten grooves.

11. The device as defined in claim 6, further wherein:

the plurality of grooves of said third pulse generator board are distributed approximately evenly over several repetition sectors associated with the certain values associated with the first and second pulse generator boards and over the length of the needle bed when said certain values repeat in several sectors.

12. The device as defined in claim 6, further wherein:

the edge of the grooves of said third pulse generator board is flush with a defined needle channel of the needle bed.

13. The device as defined in claim 1, further comprising:

an evaluation and calculation unit connected to said means generating successive rectangular control pulses; and the magnetically conducting pulse generator board device has a definable and mechanically fixed association with a corresponding needle bed or gauge.

14. The device as defined in claim 1, wherein:

a rectangular control pulse is selected from the second successive rectangular control pulses generated which leads, depending on carriage speed, the rectangular control pulses directly associated with a needle to be selected.

* * * * *

UNITED STATES PATENT AND TRADEMARK OFFICE

CERTIFICATE OF CORRECTION

PATENT NO. : 4,773,236

DATED : September 27, 1988

INVENTOR(S) : Jurgen Ploppa, Franz Schmid, Gerd Mak and Horst Fries

It is certified that error appears in the above-identified patent and that said Letters Patent is hereby corrected as shown below:

Claim 5, column 9, line 55, "devices" should be -- device --.

Claim 7, column 10, line 23, "of" should be -- or --.

Signed and Sealed this

Twenty-eighth Day of March, 1989

*Attest:*

DONALD J. QUIGG

*Attesting Officer*

*Commissioner of Patents and Trademarks*